United States Patent [19]

Ridgeway, Jr.

[11] 4,180,867

[45] Jan. 1, 1980

[54] SPACE ENCLOSING MEMBER

[76] Inventor: Marcus L. Ridgeway, Jr., Rte. 1, Box 159, Troy, Tex. 76579

[21] Appl. No.: 881,758

[22] Filed: Feb. 27, 1978

[51] Int. Cl.[2] ..... A41D 15/04; E04B 1/347

[52] U.S. Cl. ..... 2/89; 135/1 R

[58] Field of Search ..... 2/89; 135/1 R

[56] References Cited

U.S. PATENT DOCUMENTS

| | | | |
|---|---|---|---|
| 33,528 | 10/1861 | Johns | 2/89 |
| 703,245 | 6/1902 | Faulkner | 2/89 |
| 1,215,139 | 2/1917 | Gail | 2/89 |
| 2,745,105 | 5/1956 | Schaefer | 2/89 |
| 3,958,274 | 5/1976 | Klauber | 2/89 X |

*Primary Examiner*—Louis Rimrodt

*Attorney, Agent, or Firm*—Richards, Harris & Medlock

[57] ABSTRACT

Disclosed is a multipurpose space enclosing member having a hexagonal body of sheet material with a circular opening in the center thereof and a tubular portion attached to the body at the edge of the circular opening. A drawstring gathering means is attached to the body around the periphery thereof and is exposed at each of the six corners of the hexagonal body. Buttonhole connecting means are formed around the periphery of the body and along a line on the body extending between opposite corners. A zipper pocket is formed on the body spaced from the central opening. A second drawstring gathering means is fixed to the body at the periphery of the centrally located circular opening. Third and fourth drawstring gathering means are fixed to the tubular body portion with the third gathering means positioned between the second and fourth gathering means and with the fourth gathering means positioned at the free edge of the tubular portion. The circumference of the tubular member and of the central opening is selected to be slightly larger than the maximum girth of the user of the member. The axial length or height of the tubular member is selected to be the distance from the armpit to the mid-hip of the user of the device. The distance the third gathering means is spaced from the second gathering means is selected to be equal to the radius of the central opening. A rigid structural element is provided with means thereof for interconnecting one or more of the space enclosing members together along their edges. In addition, connectors are provided for attaching the structural elements together.

16 Claims, 15 Drawing Figures

SPACE ENCLOSING MEMBER

BACKGROUND OF THE INVENTION

The present invention relates generally to a multipurpose member formed from sheet material. In another aspect, the invention relates to combination of a new and improved member and associated equipment with multiple applications in apparel, housing and transportation. In a further aspect, this invention relates to a versatile member having a hexagonal body with a centrally positioned opening therein, a tubular portion connected to the opening and wherein the tubular portion is of a size corresponding to the physical dimensions of the user of the device and wherein connecting and gathering means are strategically located to allow the device to have multiple applications.

In camping, back packing, and the like, space utilization and weight are important considerations in the selection of equipment. In back packing, for example, one normally utilizes a plurality of separate elements which are transported by the individual for clothing, tents, sleeping bags, ground cloths, packing and storage bags, and the like. In addition, due to weight and size requirements in back packing, it was difficult, if not impossible, to transport a tent of a size to house a plurality of individuals.

Conventionally, a plurality of separate elements are used to satisfy the equipment needs of back packing and a separate and different size tent is required depending on the number of people to be housed in the tent.

Although these systems had served the purpose, there is a need to improve this type of equipment. This need has become acute with the increased cost of elements and equipment acceptable in both the weight and space requirements. Furthermore, since various sizes of groups of individuals are engaged in these types of endeavors, a need has arisen for equipment which breaks down into a small enough unit for an individual to carry and which cooperates with equipment carried by other individuals.

Therefore, according to one embodiment in the invention, an improved spaced enclosing member is provided according to a particular structure for applications as a back pack, duffel bag, sleeping bag, ground cloth, poncho, article of clothing and a tent.

According to another embodiment of the invention, an improved space enclosing member is provided of a particular shape and with connecting means along the edge for interconnecting a plurality of the members together to expand the capacity and utility of the member.

The present invention also contemplates the use of an improved space enclosing member having a hexagonal shaped body with a connecting means along the periphery of the body and a circular opening in the center thereof. A tubular portion is attached to the body at the periphery of the circular opening and is dimensioned corresponding to the physical size of the individual using the member. The member is provided with gathering means which also function to allow interconnection of the members together and adaptability of the member into various applications. The invention also contemplates the use of a structural element which can be used to interconnect the elements or as a rigid support and connectors for use with the structural elements for connecting the structural elements together.

The present invention will be readily appreciated by those of ordinary skill in the art as the same becomes better understood by reference to the following detailed description when considered in connection with the accompanying drawings in which:

DESCRIPTION OF THE PREFERRED EMBODIMENT

Figure 1:
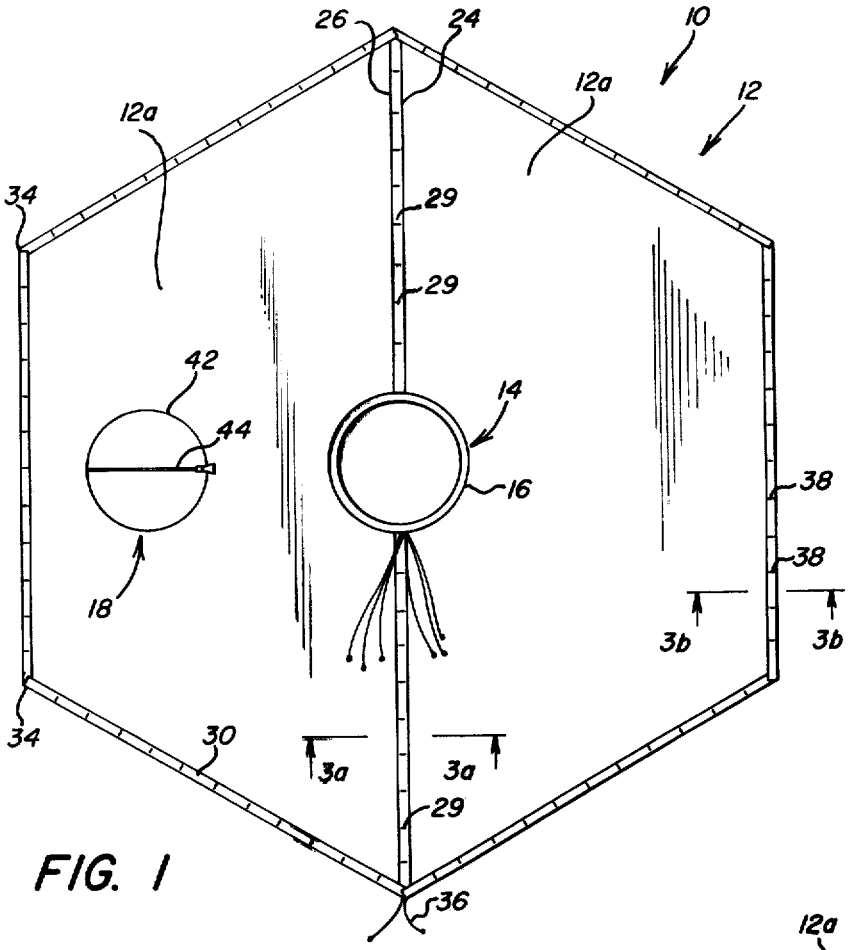
FIG. 1 illustrates a plan view of the space enclosing member of the present invention.
Figure 2:
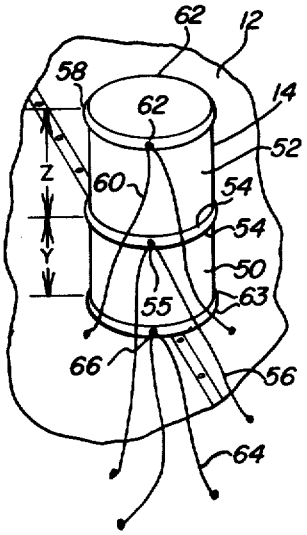
FIG. 2 is a partial perspective view of the tubular portion of the member illustrated in FIG. 1.

Referring now to FIGS. 1 and 2, wherein like reference characters designate like or corresponding parts throughout the several views, there is shown an improved space enclosing member of the present invention which, for purposes of description, is generally identified by reference numeral 10. The member 10 can be formed from any of a number of woven, knitted, sheet, or quilted materials such as cotton, nylon, dacron, sheet plastic, netting, and the like. It is also contemplated that the various component parts used to form the member 10 can be made from the same materials or selective elements made from the different materials or the same materials of different colors.

The member 10 has a body portion 12 and a tubular portion 14. The body portion 12 has a circular centrally positioned opening 16 of a circumference equal to the circumference of the portion 14. A pocket or pouch 18 is formed on the body 12.

Figure 3A:
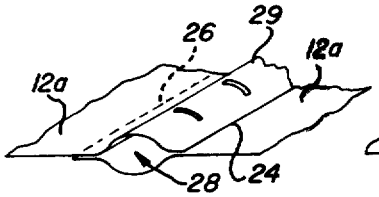
FIG. 3*a* is a partial section view taken along line 3*a*—3*a* of FIG. 1 looking in the direction of the arrows.
Figure 3B:
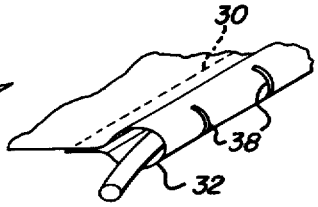
FIG. 3*b* is a partial section view taken along line 3*b*—3*b* of FIG. 1 looking in the direction of the arrows.
Figure 3:
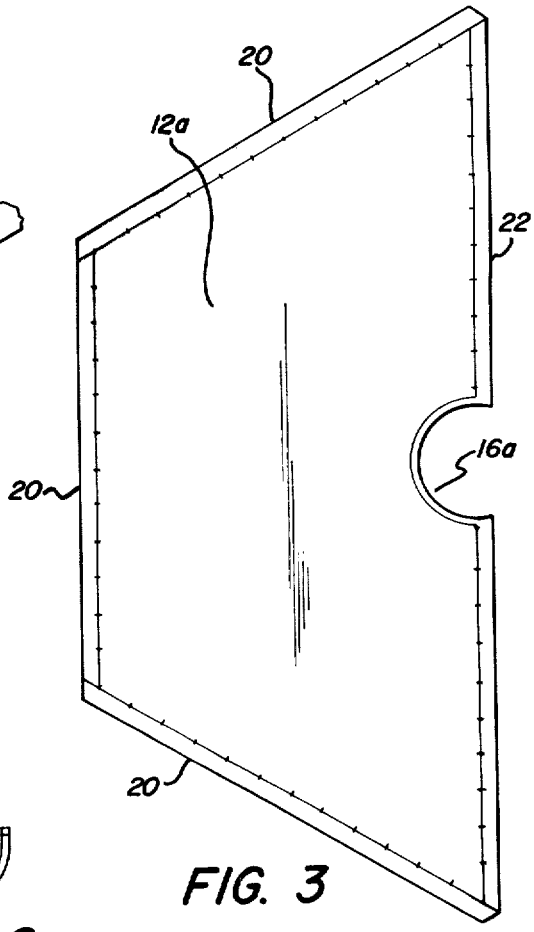
FIG. 3 illustrates a pattern element used in forming the bodies of the space enclosing member of the present invention.

The individual elements for forming the member 10 are illustrated in FIGS. 3–6. The body portion 12 is formed by two identical sheets of material 12*a*. In the preferred embodiment, the body portion 12 has a regular hexagonal shape and thus the sheets 12*a* are trapezoidal shaped, each having three shorter edges 20 of equal length and a fourth larger edge 22. In the preferred embodiment, each of these shorter edges 20 has a finished length of 1 meter. As can be seen in FIG. 3, sheet 12*a* has an arcuate edge 16*a* formed in the long edge 22 thereof. The arcuate portion 16*a* has a constant radius and extends slightly more than 180° to accommodate overlapping of the two sections 12*a*. The arcuate portion 16*a* is positioned centrally on the edge 22.

To form the body 12, the two sheets 12*a* are overlapped at the edges 22 and joined together along two parallel spaced seam lines 24 and 26. An elongate pouch 28 is formed by the seam lines 24 and 26 between the overlapping portions of sheets 12*a*. It is to be understood, of course, that these seam lines (and the others hereinafter described) could be formed by nonadhesive, heat sealing, sewing or the like as dictated by the type of material used.

A plurality of spaced buttonholes 29 are formed in one of the sheets 12*a* between the seam lines 24 and 26 to provide spaced access to the interior of pouch 28.

Edges 20 are folded as shown in 3*b* and seamed along seam lines 30 to form a passageway 32 along each of the edges 20. Each of the passageways 32 are open at the ends or corners 34 where the edges 20 intersect. Cording material 36 extends through the passageways 32 completely around the periphery of the body portion 12. This cording material 36 and the passageway 32 form a gathering means or drawstring, the purpose of which will be hereinafter later described. In the preferred embodiment, a plurality of spaced buttonholes 38 are formed in the material and provide spaced access to the interior of the passageway 32. These buttonholes in the preferred embodiment extend completely around the periphery of the body portion 12 and allow lacing of two separate members 10 together along one of the edges 20. It is also contemplated that other means could be provided along the edges 20 to attach the elements together along the edges 20 such as zippers, buttons, hooks, ties, velcro, slotted woven webbing or tape and the like.

Figure 6:
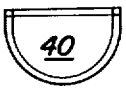

Pocket 18 is formed on panel 12*a* as shown in FIG. 1. Pocket 18 is assembled from two semicircular portions 40, such as shown in FIG. 6. Semicircular portions 40 are identical in shape and can be formed from sheet material. The portions 40 are fixed or attached to the sheet 12*a* along seam line 42. A zipper or similar closure means 44 is provided on the two circular portions 40 for selective opening and closing of the pocket 18, the pocket 18 being formed between the two semicircular portions 40 and the adjacent portion of the sheet 12*a*. In the preferred embodiment, only one such pocket is provided on the member 10, but it is contemplated, of course, that more could be provided as desired and as space would allow. Also the pocket is of a size to allow insertion of the member 10 therein.

Figure 4:
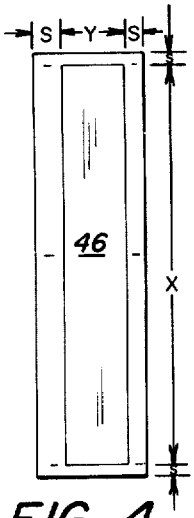
FIGS. 4–6 illustrate pattern elements for forming the tubular portion and the pocket of the member.
Figure 5:
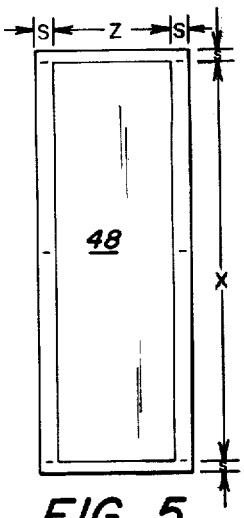

Tubular portion 14 is formed from two rectangular sheets of material 46 and 48, shown respectively in FIGS. 4 and 5. Each of the sheets 46 and 48 has a major dimension which is slightly longer than the length represented by the letter X. In the present embodiment, the dimension X is equal to the circumference of the opening 16, and the major dimension of each of the sheets 46 and 48 is equal to the dimension X plus a small amount for seam overlap.

When the sheet 46 is formed into a tubular portion by double seaming the smaller edges together, a tube is formed having a circumference of X. The tube made from the sheet material 46 forms the inner section 60 of the tubular portion 14. Sheet 48 is likewise formed into a tubular member having a circumference of X by seaming along the shorter side. The tubular member made from sheet 48 forms the outer section 52 of the tubular portion 14. Outer and inner sections 50 and 52, respectively, are overlapped axially and joined together by two spaced seam lines 54 which in turn form a passageway around the periphery of the tubular portion 14. Buttonholes 55 are formed on opposite sides of the tubular portion 14 and provide access into the interior of the passageway formed between the seam lines 54. A cording 56 extends through the passageway to form drawstring or gathering means. In a similar manner, the extending end of the outer section 52 is overlapped and seamed along line 58 to form a passageway around the periphery of the outer section 52. Cord 60 extends through the passageway and buttonholes 62 are formed on opposite sides to provide access to the interior of the passageway through which the cordage 60 passes.

The extending end of the inner section 50 is overlapped with the sheets 12*a* at the edge of opening 16 and is seamed thereto along parallel spaced seam line 63 to form a passageway. A cordage 64 extends through the passageway and buttonholes 66 are formed on opposite sides of the tubular portion 14 to provide access to the interior of the passageway through which cordage 64 extends.

According to a particular feature of the present invention, the minor or lesser dimension (excluding seam allowances S, which in the preferred embodiment are 44 mm) of the sheets 46 is selected to be equal to the radius Y of a circle whose circumference is equal to the circumference of the tubular member plus a small amount S for seam overlap. This dimension is graphically illustrated by Y. The minor or shorter dimension of the sheet 46 is Y plus small amounts S for seam allowance. The minor or shorter dimension of the sheet 48 is selected such that the section 52 will have a height of Z.

According to a particular feature of the invention, the dimensions of the member 10 are selected in relation to the body dimensions of the individual for which the member is designed. In the preferred embodiment, each of the edges 20 are selected to be one meter in length. The opening 16 is selected to be of a size whose circumference is slightly larger than the size of a person's greatest girth. This allows the member to be slipped over the torso of an individual as will be hereinafter described in detail.

This major dimension X of the sections 46 and 48 is thus selected to equal the circumference of the opening 16. The height Y of the section 50 is selected to be equal to the radius of the opening 16. This allows the portion 14 to be drawn closed along seams 54 by means of cordage 56 with the section 50 filling opening 16.

The combined height of the sections 50 and 52 Y plus Z is selected to be equal to the distance from the armpit to mid-hip of the individual for which the member is designed. By interrelating the dimensional aspects of the member 10 as taught herein, a plurality of the applications and uses for the member are made possible.

Figure 7:
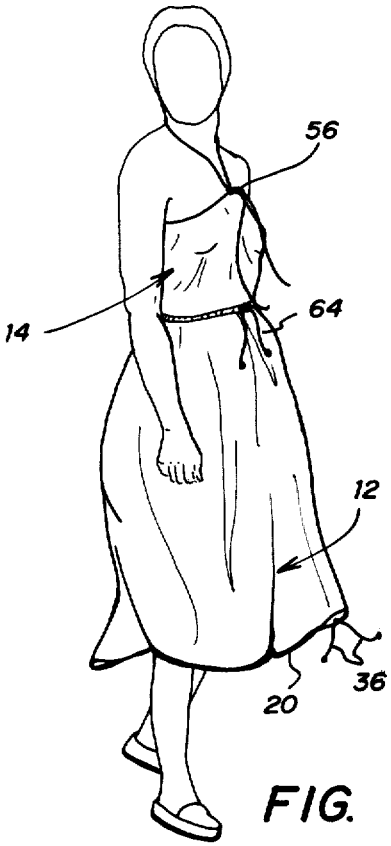
FIGS. 7 and 8 illustrate the member of FIG. 1 used as an article of clothing.

For example, in FIG. 7, the member 10 is shown being uses as wearing apparel with the body portion 12 draped down over the hips and gathering means formed by cordage 54 cinched at the waist as shown. The upper section 52 is tucked inside of the lower section 50 and the lower section is pulled up under the arms of the wearer and the cordage 56 passes behind the neck of the wearer as shown.

Figure 8:
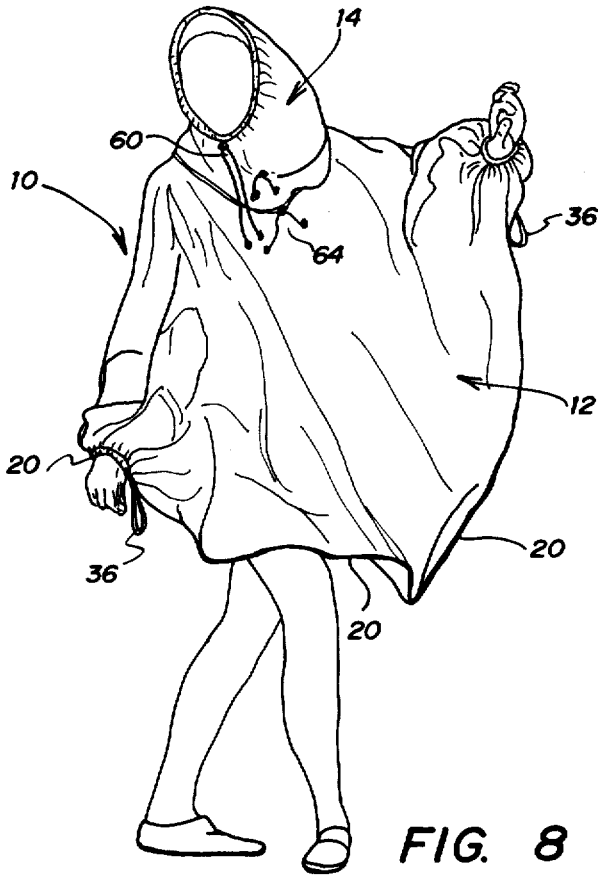

Another example of an application of the member 10 is shown in FIG. 8. In this embodiment, body portion 12 is draped down from the shoulders and the cordage 36 gathers one of the edges 20 around each of the wrists. The tubular portion 14 fits up over the head of the wearer with the cordage 60 gathered up to form an opening for the face of the wearer.

Many other configurations for using the member 10 as wearing apparel are anticipated. For example, the member 10 can be worn in a manner similar to that shown in FIG. 7 with the upper section 52 extended and the cordage 60 being drawn up around the neck and the cordage 56 being drawn up around the waist. This configuration makes a longer dress than that shown in FIG. 7. In another application, the cordage 64 can be drawn up around the waist with the tubular portion 14 extending down over the hips to form a slip and body portion 12 forming a dress. It is also anticipated that the member 10 could be worn as a cape by folding the body portion in half with the tubular portions forming in one embodiment a head covering portion of the cape and in another embodiment creating a small pack over the back of the shoulders. The variety of applications disclosed herein are illustrative only, and it is to be understood, of course, that other applications as wearing apparel are possible, in that the versatility of this member is, as a result, not only of its particular configuration, but also the dimensional relationship of the member to the body of the individual using the device.

Figure 9:
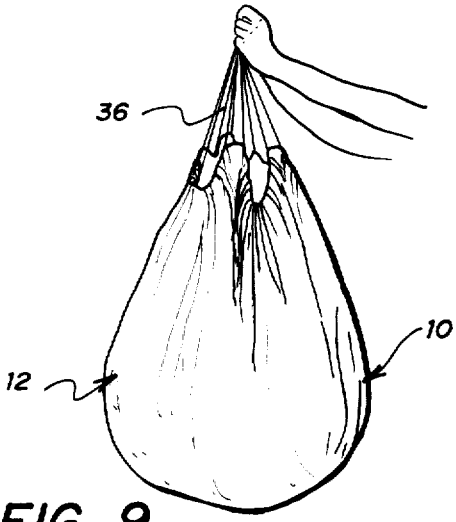
FIG. 9 illustrates the member of FIG. 1 used as a duffel bag.

In FIG. 9, the member 10 is shown used as a multipurpose duffel bag. In this embodiment, cordage 56 is drawn up to close the opening 16, and cordage 36 in the hem of the body portion 12 is pulled from the hem at the corners 34 and gathered up as shown. It is also anticipated, although this embodiment is not shown, that the member 10 could be used to form a smaller bag by closing the cordage 64 and stuffing the body portion 12 into the tube 14 and using the cordage 60 as the other end of a smaller bag.

Figure 10:
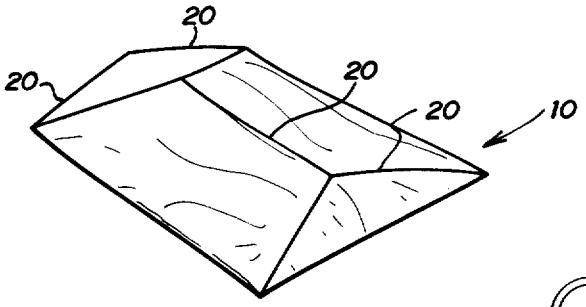
FIG. 10 illustrates the article of FIG. 1 used as a sleeping bag.

Another use is illusrated in FIG. 10 wherein the member 10 is formed into a bivouac cover or sleeping bag. The edges 20 are attached together as shown to form the elongated bag. These edges can be attached by lacing the buttonholes 38 together or by other means in embodiments wherein other types of fasteners are provided. In embodiments with buttonholes 38, the cordage 36 extending around the hem or periphery of the body member 12 can be woven or knitted by using a plurality of slip knots which allows the cordage 36 to be unwoven to extend its length and allow its use in attaching the seams or edges together.

Figure 11A:
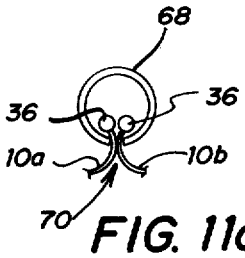
FIGS. 11, 11*a* and 11*b* illustrate an example of one of the plurality of applications to which the member may be used by attaching a plurality of elements together by use of structural elements and connectors.
Figure 11:
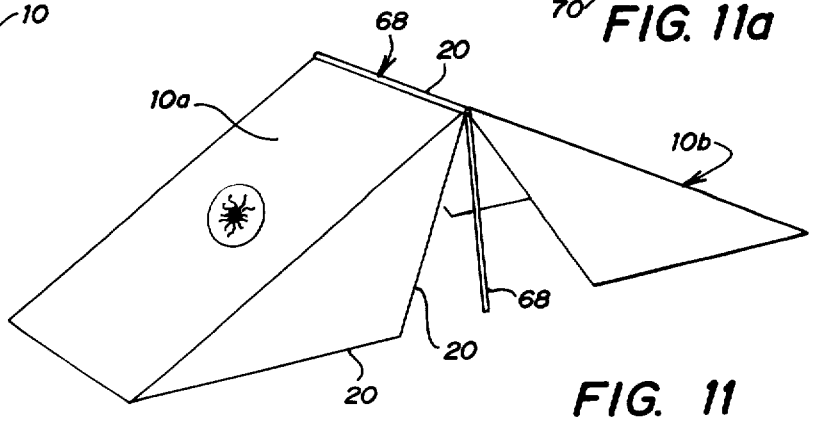

In FIG. 11, one of the many configurations into which more than one of the members 10 can be assembled is shown. In this embodiment, two members 10*a* and 10*b* are assembled to form a small tent by attaching the members together along one of the edges 20. In this embodiment, the opening 16 is closed by the cordage 56 and the pocket 42 is placed on the interior of the tent. Again, it is to be understood, of course, that this configuration could be achieved by lacing the edges 20 together through the buttonholes so provided. In such an embodiment, tent pole 68 could be of a conventional design and its only purpose being to support the tent.

Figure 11B:
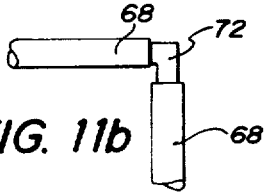

According to a particular feature of the present invention, a hollow tent pole 68 is provided having a longitudinal slot 70 therein along the length thereof. This slot 70 is of a size to allow axial insertion of one of the edges 20 into the interior of the pole 68 while preventing radial removal therefrom by reason of the slot being smaller than the cross section of the body portion 12 at the edge 20. The use of pole 68 to connect two edges together is shown in FIG. 11*a*. In addition, the tent pole 68 can be provided with a connector 72 having one or more legs extending therefrom for insertion into the tent pole 68 to connect poles as shown in FIG. 11*b*. Although the embodiment shown in FIG. 11 illustrates connection of only two of the members, it is to be understood, of course, that many more could be assembled into a larger habitation by connecting the members together at their edges.

From the foregoing, it can be seen that the member of the present invention by reason of both its shape and dimensional relationship to the individual user provides multipurpose applications and uses not heretofore present in a single space enclosing member.

It is also to be understood, of course, that the foregoing disclosure relates only to a preferred embodiment of the present invention, that numerous alterations can be utilized to practice the present invention without departing from the spirit of scope of the invention as defined in the appended claims.

What is claimed is:

1. A multipurpose member of sheet material comprising:

a hexagonal shaped body portion having a centrally positioned opening;

a tubular portion attached to said body portion, said tubular portion being of a diameter equal to the diameter of said central opening in said body portion, said tubular portion having one end attached to said body portion along the edge of said circular opening; and means are provided on said tubular portion spaced from the ends thereof for gathering said tubular portion, said gathering means being positioned on said tubular portion a distance Y from the edge of said central opening wherein Y is equal to the radius of said central opening.

2. The member of claim 1 wherein means are attached around the periphery of said body portion for gathering the edges of said body portion.

3. The member of claim 2 wherein said edge gathering means comprises a hem forming a passageway extending around the periphery of said body portion and cordage extends through said passageway.

4. The member of claim 3 additionally comprising a plurality of openings in said hem spaced around the periphery of said body portion.

5. The member of claim 2 wherein means are attached around the periphery of said central opening for gathering said body portion at said central opening.

6. The member of claim 5 wherein said gathering means comprises a passageway formed between two layers of said sheet material and cordage extends through said passageway.

7. The member of claim 5 wherein means are attached on said tubular portion at the end opposite said central opening for gathering said tubular portion.

8. The member of claim 7 wherein said gathering means comprises a passageway formed between two layers of said sheet material and cordage extends through said passageway.

9. The member of claim 1 wherein a pocket is provided in the body portion and means are provided for opening and closing the pocket.

10. The member of claim 1 wherein said tubular member gathering means comprises a passageway formed between two layers of said sheet material and cordage extends through said passageway.

11. The member of claim 1 wherein the diameter of said central opening is selected to be a size slightly greater than the maximum girth of the individual user of the member.

12. The member of claim 11 wherein the axial length of the tubular portion is equal to the distance from the armpit to mid-hip of the individual user of the member.

13. The member of claim 1 in combination with a pole, said pole having a chamber extending along the length thereof and a slot providing access to the chamber with one of the edges of said member inserted axially into and retained in the chamber of said pole.

14. The combination of claim 13 wherein a plurality of poles are provided and wherein a connector means is provided connecting the poles together.

15. The member of claim 1 wherein a seam is formed across the body of said member from opposed corners to intersect the edge of said central opening, openings are formed in said seam at spaced locations.

16. The member of claim 1 wherein means are attached around the periphery of said central opening for gathering said body portion at said central opening.

* * * * *